US008840440B2

(12) United States Patent
Pierce

(10) Patent No.: US 8,840,440 B2
(45) Date of Patent: Sep. 23, 2014

(54) BALLOON HOLDER

(75) Inventor: Karen A. Pierce, La Mirada, CA (US)

(73) Assignee: Express Dental Products, Inc., La Mirada, CA (US)

( * ) Notice: Subject to any disclaimer, the term of this patent is extended or adjusted under 35 U.S.C. 154(b) by 176 days.

(21) Appl. No.: 13/477,976

(22) Filed: May 22, 2012

(65) Prior Publication Data

US 2012/0312762 A1 Dec. 13, 2012

Related U.S. Application Data

(60) Provisional application No. 61/494,530, filed on Jun. 8, 2011.

(51) Int. Cl.

| | |
|---|---|
| ***A63H 3/06*** | (2006.01) |
| *B65H 75/38* | (2006.01) |
| *A63H 27/10* | (2006.01) |

(52) U.S. Cl.

CPC ..... *A63H 27/10* (2013.01); *A63H 2027/1008* (2013.01); *A63H 2027/1041* (2013.01)

USPC ..... 446/220; 446/223; 242/405.1

(58) Field of Classification Search

USPC ..... 211/13.1; 446/220, 222, 223, 225, 226, 446/221, 224; 294/159; D9/434; 40/642.01, 40/649, 661.05, 667; 242/400.1, 405, 242/405.1; D8/356, 358

See application file for complete search history.

(56) References Cited

U.S. PATENT DOCUMENTS

| | | | | | |
|---|---|---|---|---|---|
| 1,680,318 | A * | 8/1928 | Callahan | 446/222 |
| 3,267,604 | A * | 8/1966 | Goldsmith | 446/222 |
| 3,366,999 | A * | 2/1968 | Darby | 446/222 |
| 4,715,841 | A * | 12/1987 | Nelson et al. | 446/222 |
| 5,181,757 | A * | 1/1993 | Montoya | 294/159 |
| D340,863 | S * | 11/1993 | Daigle | D9/434 |
| 5,755,419 | A * | 5/1998 | Gearhart et al. | 248/346.01 |
| 5,964,636 | A * | 10/1999 | Carrera | 446/220 |
| 6,375,534 | B1 * | 4/2002 | Burns | 446/220 |
| 6,582,272 | B1 * | 6/2003 | Nelson et al. | 446/220 |
| 6,716,083 | B1 * | 4/2004 | Castro | 446/220 |
| 7,178,754 | B2 * | 2/2007 | Anderson | 242/402 |
| 7,249,991 | B1 * | 7/2007 | Watson | 446/220 |
| D610,208 | S * | 2/2010 | Hou | D21/453 |
| 2001/0022331 | A1 * | 9/2001 | Smith | 242/404 |
| 2002/0155780 | A1 * | 10/2002 | Verner et al. | 446/220 |
| 2004/0077268 | A1 * | 4/2004 | Wainohu | 446/222 |
| 2006/0292960 | A1 * | 12/2006 | Muller | 446/220 |
| 2012/0184175 | A1 * | 7/2012 | Gilbert et al. | 446/222 |

* cited by examiner

*Primary Examiner* — Patrick Hawn

(74) *Attorney, Agent, or Firm* — Cislo & Thomas, LLP

(57) ABSTRACT

A holder for a floating balloon having a variety of protrusions or holes form to or through which a floating balloon can be tied, and a slit to allow a first end and a second and to be separated apart so that the holder can be attached to a variety of objects or human body parts.

3 Claims, 2 Drawing Sheets

BALLOON HOLDER

CROSS-REFERENCE TO RELATED APPLICATION

This patent application claims the benefit of U.S. Provisional Patent Application No. 61/494,530, entitled "Balloon Holder," filed Jun. 8, 2011, which application is incorporated in its entirety here by this reference.

BACKGROUND OF THE INVENTION

1. Technical Field

This invention relates to a device for holding floating balloons, such as helium balloons.

2. Background Art

Floating balloons, such as helium balloons, are very popular for special occasions, such as birthday parties, graduations, and many other celebrations. Often times helium balloons are used to adorn the celebration venue. Strips of ribbon are used to tie the helium balloon to a fixed object, such as a chair or table. If the host is dissatisfied with the placement of the balloon or the height of the balloon, he or she will have to untie the balloon from the chair or table and re-tie the balloon to another chair or table, or at a different height. Continued dissatisfaction results in continuously tying and re-tying the balloon, thereby, wasting precious time.

In addition, as the celebration comes to a conclusion, and guests begin to leave, often times the guests want to take the balloons home or the host offers balloons to the guests to take home. This, again, requires untying the balloon from its fixed location and re-tying the balloon onto the guest's wrist. Usually, so as to prevent the balloon from becoming untied on its own, the balloons are tied with a knot. Therefore, untying the balloon requires undue diligence or the need for a knife or scissor to cut the ribbon.

Thus, there is a need for a device that allows floating balloons to be quickly and easily fixed to an object, and quickly and easily removed from the object, while at the same time allowing the height of the balloon to be modified with the ease.

BRIEF SUMMARY OF INVENTION

The present invention is directed to a balloon holder that allows floating balloons to be quickly and easily fixed to an object, and quickly and easily removed from the object, while at the same time allowing the height of the balloon to be modified with the ease. The balloon holder comprises an inner perimeter and an outer perimeter that define a surface, and a central void. The inner and outer perimeters further comprise protrusions onto which balloons may be tied. The surface and/or the protrusions may further comprise through-holes through which balloons may be tied.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
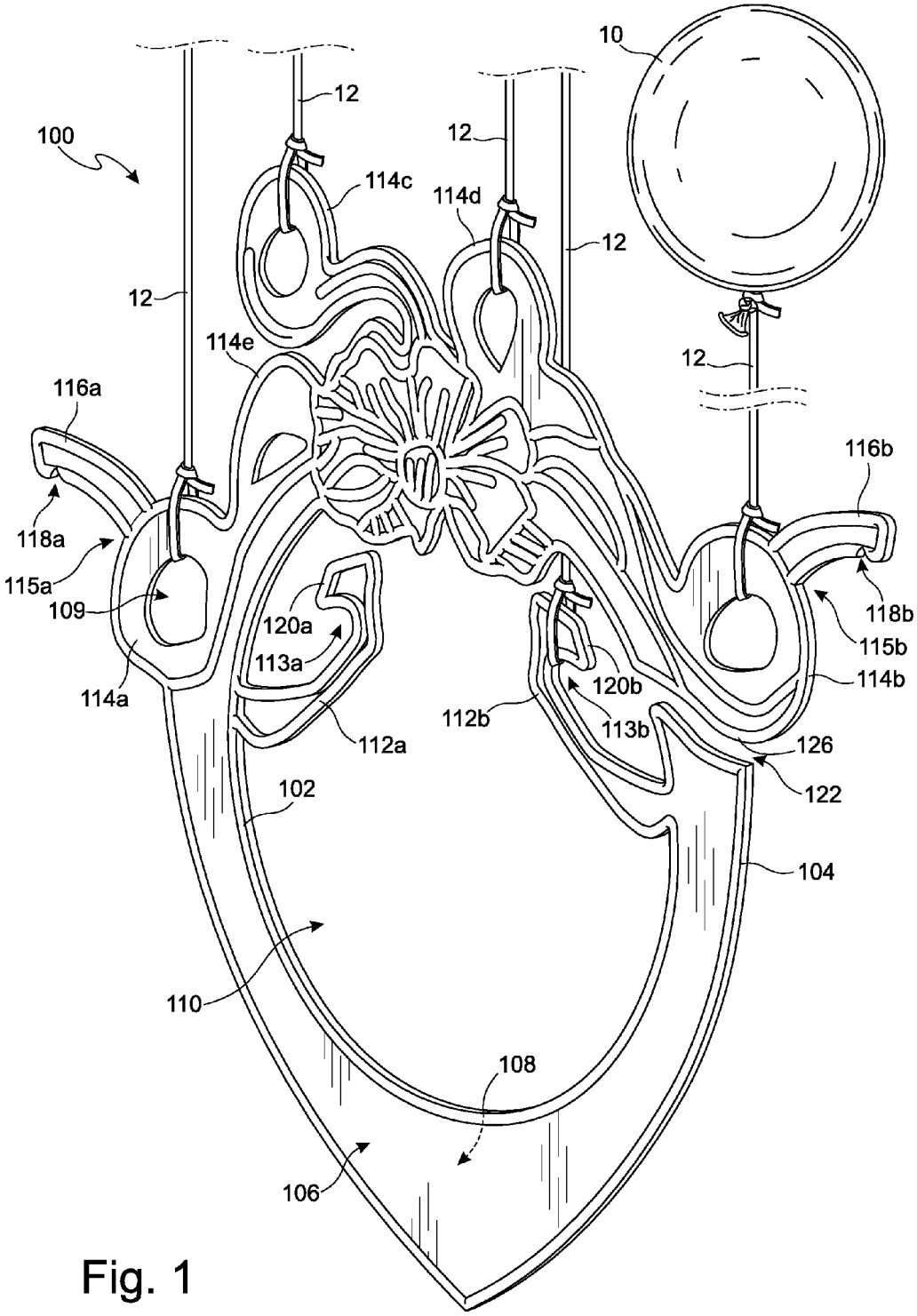
FIG. 1 is a front view of an embodiment of the present invention. Note, the balloon is not drawn to scale, but rather, has been reduced in size to show the general concept.

As shown in FIG. 1, the balloon holder 100 is configured to hold a plurality of balloons 10 and to be attachable to a variety of items, including a person. The holder 100 comprises an inner perimeter 102 and an outer perimeter 104, the inner and outer perimeters 102, 104 defining a first surface 106 and a second surface 108 opposite the first surface 106. In some embodiments, the balloon holder 100 may comprise a through-hole 109 extending from the first surface 106 to the second surface 108.

The inner perimeter 102 also defines a void 110 through which various items can be inserted. In the preferred embodiment, the void 110 is generally a circular shape. However, the void 110 can be any shape that still allows various objects to be inserted therein.

The inner perimeter 102 may further comprise various inner protrusions 112*a*, 112*b* or contours projecting into the void 110. Preferably, each inner protrusion 112*a*, 112*b* comprises a catch portion to provide a means for securing a balloon 10 with a tie 12. For example, a catch can be of a variety of forms such as simple projecting arms, hooks, bends, notches, crevices, eye loops, bulges, expansions, and the like, or any combination thereof. In some embodiments, the inner protrusions 112*a*, 112*b* may be a symbol, a design, or an artistic representation of something else. In the preferred embodiment, the inner protrusions 112*a*, 112*b* are configured so as to allow a tie 12, such as a string, ribbon, and the like to be tied to it. For example, the inner protrusions 112*a*, 112*b* may have bent or curved arms 113*a*, 113*b*, or through-holes, notches, and the like, like those shown on the outer protrusion 114*a*, 114*b* described below to form the catch portion.

Similarly, the outer perimeter 104 may also comprise various outer protrusions 114*a-e* or contours projecting away from the holder 100. Like the inner protrusions 112*a*, 112*b*, the outer protrusions 114*a-e* can take on a variety of forms to create a catch portion for the tie of a balloon, such as projecting or bent arms 116*a*, 116*b*, hooks 115*a*, 115*b*, eye loops or through-holes 109, and the like. Like the inner protrusions 112*a*, 112*b* the outer protrusions 114*a-e* are configured so as to allow a tie 12 to be tied to it.

Figure 2:
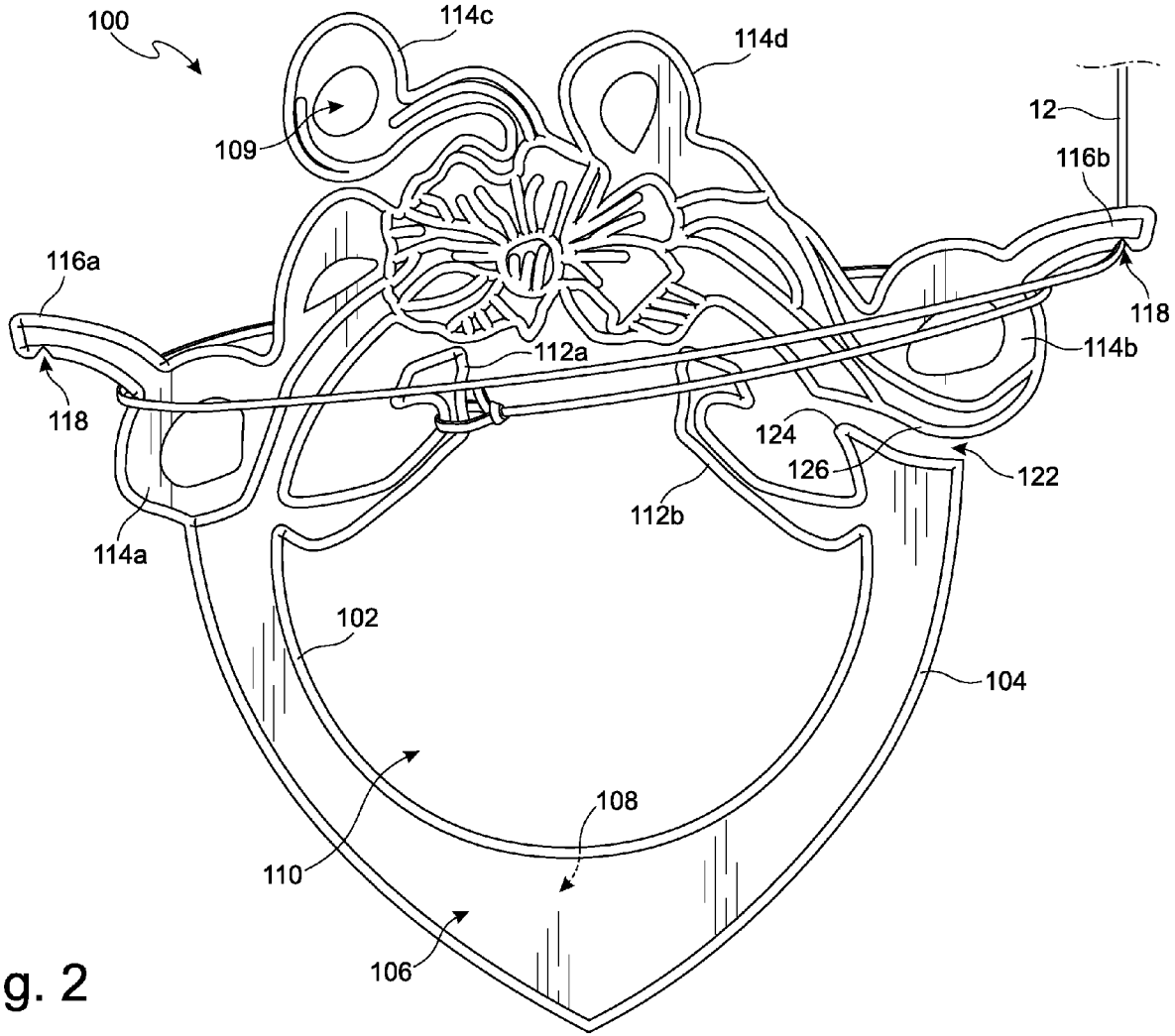
FIG. 2 is a perspective view of the embodiment shown in FIG. 1.

In some embodiments, the holder 100 may comprise at least two outer protrusions 114*a*, 114*b*, wherein each outer protrusion 114*a*, 114*b* has an arm 116*a*, 116*b* that is directed away from the other outer protrusion 114*b*, 114*a*. This configuration allows for the tie 12 to be wrapped around the two outer protrusions 114*a*, 114*b* so as to govern the height of the balloon 10 as shown in FIG. 2. If the balloon 10 is too high the user can continue to wrap the tie 12 around the two protrusions 114*a*, 114*b* to lower the height of the balloon 10. Conversely, if the height of the balloon 10 is too low the user can unwrap the tie 12 from the two protrusion 114*a*, 114*b* to increase the height of the balloon 10. Having portions of the protrusions 114*a*, 114*b* directed away from each other prevents the tie 12 from slipping off the protrusions 114*a*, 114*b*.

In some embodiments, at least one protrusion 114*a* may have a notch 118 into which the tie can be wedged so as to prevent the tie from undesirably falling off of the protrusion

114*a*. The notch 118 may have sharp edges so as to function as a cutter to cut the tie 12 if desired.

Similarly, the holder 100 may comprise two inner protrusions 112*a*, 112*b*, wherein each inner protrusions 112*a*, 112*b* each has a tip portion 120*a*, 120*b* that is directed away from the other protrusion 112*b*, 112*a* so as to form a catch at their respective tip portions 120*a*, 120*b*. Again, this allows the user to wrap the tie 12 around the inner protrusions 112*a*, 112*b* to adjust the height of the balloon 10.

In some embodiments, the holder 100 or a portion of the holder 100 may be designed to imitate well-known objects, and in particular, objects associated with the special occasion for which the balloons 10 have been acquired. For example, during a child's birthday party helium balloons may be displayed throughout the room. The balloon holders 100 can be in the shape of birthday presents tied with ribbons or a birthday cake with candles. If the child is known to enjoy cars, then the balloon holders 100 can be in the shape of cars. If the child is known to enjoy animals, then the balloon holders 100 can be in the shape of a particular animal. If the celebration is a graduation, the balloon holders 100 can be in the shape of a diploma, book, graduation cap, and the like. For other events, the holder 100 may be in the shape of plants, flowers, and the like.

In some embodiments, the inner protrusions 112*a*, 112*b* and/or outer protrusions 114*a-e* may be in the shape of letters of an alphabet so as to spell out an individual's name or abbreviations for a name.

In some embodiments, the balloon holder 100 may further comprise a complete split or break 122, thereby, defining a first free end 124 and a second free end 126. The first end 124 and the second end 126 are adjacent to each other and define a gap therebetween created by the break 122. In some embodiments, the gap may be so small that it is not easily or generally perceptible. Nonetheless, since there is a split, the first end 124 and the second end 126 can be pulled away from each other, due to the material and configuration, so as to enlarge the break 122 and allow an object or a person's body part to be inserted into the void 110, thereby, allowing the balloon holder 100 to be hooked on to the object or the person's body part. Balloons 10 can be attached to the various inner and outer protrusions 112, 114. Therefore, the balloon holder 100 provides a quick and easy means for attaching balloons 10 to some object or person.

Often times at children's birthday parties, the children want to take a helium balloon 10 home with them. By having the displayed helium balloons 10 attached to the balloon holder 100, the child is now able to quickly and easily detach the helium balloon 10 from whatever fixture it was attached to and transfer it onto his or her wrist to safely carry it home.

The balloon holder 100 may be made from a variety of different materials that provide sturdiness with some flexibility and elasticity so as to be able to return to its original configuration after being bent out of shape. For example, the balloon holder 100 may be made from plastic, metal, wood, and the like. Preferably, the balloon holder 100 is generally flat with all features generally lying in a single main plane. However, projections 112*a*, 112*b*, 114*a-e* can project into different planes that are perpendicular or oblique to the main plane.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A balloon holder, comprising:

a. a flat body lying entirely in a single plane and being defined by an inner perimeter and an outer perimeter, the inner and outer perimeters defining a first surface and a second surface opposite the first surface, the inner perimeter defining a circular void through which an item can be inserted, wherein a through-hole extends from the first surface to the second surface;

b. a split within the body creating a first free end and a second free end adjacent to the first free end separated by a gap substantially narrower that a diameter of the circular void;

c. at least two inner protrusions along the inner perimeter and projecting into the circular void, wherein each inner protrusion has a catch portion, wherein the body is sufficiently flexible and elastic to allow the first free end and the second free end to be moved apart, thereby temporarily widening the gap to allow the item to be inserted; and d. at least two outer protrusions each comprising a catch portion, wherein at least one outer protrusion has a notch into which a tie can be wedged so as to prevent the tie from undesirably falling off of the at least one outer protrusion.

2. A balloon holder, comprising:

a. a flat body lying entirely in a single plane and being defined by an inner perimeter and an outer perimeter, the inner and outer perimeters defining a first surface and a second surface opposite the first surface, the inner perimeter defining a circular void through which an item can be inserted, wherein a through-hole extends from the first surface to the second surface;

b. at least two inner protrusions along the inner perimeter and projecting into the circular void and terminating at a tip portion, each inner protrusion comprising a catch portion at the tip portion;

c. a split within the body creating a first free end and a second free end adjacent to the first free end, wherein the first free end converges towards the second free end and is separated by a gap; and d. at least two outer protrusions projecting away from the holder on the outer perimeter and each comprising a catch portion, wherein at least one outer protrusion has a notch into which a tie can be wedged so as to prevent the tie from undesirably falling off of the at least one outer protrusion.

3. A balloon holder, comprising:

a. a flat body lying entirely in a single plane and being defined by an inner perimeter and an outer perimeter, the inner and outer perimeters defining a first surface and a second surface opposite the first surface, the inner perimeter defining a circular void through which an item can be inserted, wherein a through-hole extends from the first surface to the second surface;

b. the body comprises a split within the body creating a first free end and a second free end adjacent to the first free end, wherein the first free end converges towards the second free end and is separated by a gap, wherein the body is sufficiently flexible and elastic to allow the first free end and the second free end to be moved apart, thereby temporarily widening the gap to allow the item to be inserted;

c. at least two inner protrusions, wherein each inner protrusion comprises a catch portion; and d. at least two outer protrusions on the outer perimeter projecting away from the holder, each comprising a catch portion, wherein at least one outer protrusion has a notch into which a tie can be wedged so as to prevent the tie from undesirably falling off of the at least one outer protrusion.

* * * * *